US005940919A

United States Patent [19]

Vanderlinden

[11] Patent Number: 5,940,919

[45] Date of Patent: Aug. 24, 1999

[54] DRAG SHOE FOR USE IN A STREET SWEEPING VEHICLE

[76] Inventor: Roger P. Vanderlinden, 73 Sherman Ave. S., Hamilton, Canada

[21] Appl. No.: 08/960,457

[22] Filed: Oct. 29, 1997

[51] Int. Cl.[6] ..... E01H 1/04

[52] U.S. Cl. ..... 15/84; 15/83

[58] Field of Search ..... 15/83–86, 78, 15/79.1, 79.2, 80–82, 87

[56] References Cited

U.S. PATENT DOCUMENTS

| | | | |
|---|---|---|---|
| 1,456,393 | 5/1923 | Martin | 15/84 |
| 3,186,016 | 6/1965 | Gehman et al. | 15/85 |
| 3,588,937 | 6/1971 | Scruggs et al. | 15/84 |
| 4,951,342 | 8/1990 | Wilson | 15/83 X |

*Primary Examiner*—Mary Spisich

[57] ABSTRACT

A street sweeping vehicle has a generally centrally disposed longitudinal axis, a sweeping brush disposed laterally across the longitudinal axis for sweeping debris forwardly into an elevator disposed forwardly of the sweeping brush and laterally across the generally centrally disposed longitudinal axis, and opposed left and right drag shoes disposed on opposite sides of the longitudinal axis and laterally bordering the sweeping brush and elevator. The elevator lifts debris received from the sweeping brush into a hopper for subsequent controlled dumping therefrom. Each drag shoe comprises a main body member having a front end and a back end. A mounting assembly permits mounting of each drag shoe on the street sweeping vehicle in road tracking relation. A bottom surface is shaped for substantially sealed contact with a road surface. A generally vertically disposed inwardly facing side surface has a contacting portion situated in intimately contacting relation against the sweeping brush so as to substantially preclude debris passing between the contacting portion and the sweeping brush. A first angled deflector surface having front, back, top and bottom edges is operatively mounted on the street sweeping vehicle proximate the side surface such that the front edge is disposed closer to the longitudinal axis than is the back edge. The first angled deflector surface substantially precludes direct forward passage and causes inwardly angled deflection of an impacting portion of the debris swept forwardly by the sweeping brush.

23 Claims, 4 Drawing Sheets

DRAG SHOE FOR USE IN A STREET SWEEPING VEHICLE

FIELD OF THE INVENTION

The present invention relates to street sweeping vehicles and more particularly to drag shoes for use in such street sweeping vehicles, specifically drag shoes that help preclude the trailing of debris behind the street sweeping vehicle.

BACKGROUND OF THE INVENTION

Conventional street sweeping vehicles, which have been known for several decades, comprise either a tractor or a truck frame, and have a pair of counter-rotating brooms disposed one at each side of the street sweeping vehicle. These counter-rotating brooms sweep debris from the edges of a road, or the like, even from against a sidewalk curb, to underneath the central area of the street sweeping vehicle. An elongate drum-shaped sweeping brush is disposed at the rear of the street sweeping vehicle and rotates about a horizontal axis to sweep the debris on the road forwardly to an elevator that receives the debris and lifts the debris into a hopper for subsequent controlled dumping from the hopper. A pair of opposed left and right drag shoes laterally border the sweeping brush and elevator and all together define an interior compartment that substantially contains the debris swept by the sweeping brush, before the debris is lifted by the elevator.

In use, debris builds up in front of the sweeping brush to a height of about four inches, and also tends to accumulate along the interiorly facing side surface of the drag shoes. Accordingly, the build-up of debris at the ends of the sweeping brush where the drag shoes contact the sweeping brush, tends to be quite significant. It is therefore important that the drag shoes seal against the respective ends of the sweeping brush, or in other words leave no gap between the drag shoes and the sweeping brush, so as to preclude the passage of debris rearwardly through such a gap. It is universally common with conventional street sweeping vehicles to have debris escape from between the drag shoes and the sweeping brush. Any debris that does escape through such a gap between the drag shoes and the sweeping brush will be re-deposited on the road so as to form a trail behind the street sweeping vehicle, which is unacceptable.

Also, some of the debris that is swept by the sweeping brush is directly propelled at the area of contact between the drag shoes and the respective sides of the elevator. The rotational speed of such sweeping brushes is about 180 r.p.m., or so, which tends to create quite a vigourous sweeping action. Considering that build-up of debris at the sweeping brush is typically about four inches high, it is common for such sweeping brushes to create a cloud of debris and dust up to about two feet high with the debris and dust travelling at significant speeds forwardly towards the elevator. Accordingly, it is important that the drag shoes seal against the respective sides of the elevator, or in other words leave no gap between the drag shoes and the respective sides of the elevator, so as to preclude the debris from being propelled forwardly from the sweeping brush through such a potential gap. However, since drag shoes must move up and down to follow a roadway surface, it is very difficult for conventional drag shoes maintain a proper seal against the elevator, especially after the mounting bearings of the drag shoes are worn. Due to such lack of sealing of drag shoes against the respective sides of the elevator, it is universally common with conventional street sweeping vehicles to have debris escape from between the drag shoes and the elevator.

Any debris that does escape through such a gap between the drag shoes and the respective sides of the elevator would be re-deposited on the road so as to form a trail behind the street sweeping vehicle, which is unacceptable.

As discussed briefly above, it is inevitable for bearings on the drag shoe mounting assembly to become considerably worn in less than about fifty hours of operation, which typically represents slightly over one week of use. Since it is generally not feasible to change mounting bearings each week or so, it is common for street sweeping vehicles to have worn bearings much of the time. Accordingly, most of the time, virtually all street sweeping vehicles have significant gaps between the drag shoes and the respective ends of the sweeping brush and between the drag shoes and the respective sides of the elevator, thus significantly increasing the amount of debris escaping from a street sweeping vehicle to be re-deposited on a road surface.

PRIOR ART

There are two known prior art drag shoes that are designed to ultimately preclude the passage of debris between the drag shoes and the respective ends of the sweeping brush, and between the drag shoes and the respective sides of the elevator.

One prior art drag shoe is manufactured by Sweeprite Equipment of Regina, Canada, and has a substantially vertically disposed slender deflector bar securely mounted on the drag shoe so as to present a rearwardly facing debris deflecting surface. Debris becomes trapped at the forwardly facing junction of the deflector bar and the drag shoe, and tends to accumulate substantially. Inevitably, the drag shoe is lifted by the accumulated debris, thus permitting debris to escape beneath the drag shoe, which escaped debris is re-deposited on the road so as to form a trail behind the street sweeping vehicle.

Another prior art drag shoe is manufactured by FMC Corporation of Chicago, U.S.A., and has an outwardly projecting portion with a low profile ramp that is inclined from back to front and a leading debris deflecting surface that is angled inwardly from fore to aft. The ramp causes portions of the debris swept forwardly by the sweeping brush to be deflected directly at the area of contact between the drag shoes and the respective sides of the elevator, thus permitting escape of debris, which escaped debris is re-deposited on the road so as to form a trail behind the street sweeping vehicle. The debris deflecting surface deflects debris on a road surface inwardly away from the outwardly projecting portion so as to preclude debris from accumulating in front of the outwardly projecting portion. Accumulated debris in front of the outwardly projecting portion would cause the outwardly projecting portion, and thus the drag shoe, to lift, thereby permitting the debris to remain on the road surface.

There are no known prior art drag shoes that fully preclude the passage of debris between the drag shoes and the respective ends of the sweeping brush, and between the drag shoes and the respective sides of the elevator.

It is an object of the present invention to provide a drag shoe that fully precludes the passage of debris between the drag shoes and the respective ends of the sweeping brush, and between the drag shoes and the respective sides of the elevator.

SUMMARY OF THE INVENTION

In accordance with one aspect of the present invention, there is provided a street sweeping vehicle having a generally centrally disposed longitudinal axis, a sweeping means disposed laterally across the longitudinal axis for sweeping debris forwardly into an elevator means disposed forwardly of the sweeping means and laterally across the generally centrally disposed longitudinal axis, and opposed left and right drag shoes disposed on opposite sides of the longitudinal axis and laterally bordering the sweeping means and elevator means. The elevator means lifts debris received from the sweeping means into a hopper for subsequent controlled dumping therefrom. Each drag shoe comprises a main body member having a front end and a back end. Mounting means are provided for mounting the drag shoe on the street sweeping vehicle in road tracking relation. A bottom surface is shaped for substantially sealed contact with a road surface. A generally vertically disposed inwardly facing side surface has a contacting portion situated in intimately contacting relation against the sweeping means so as to substantially preclude debris passing between the contacting portion and the sweeping means. A first angled deflector surface having front, back, top and bottom edges is operatively mounted on the street sweeping vehicle proximate the side surface such that the front edge is disposed closer to the longitudinal axis than is the back edge. The first angled deflector surface substantially precludes direct forward passage and causes inwardly angled deflection of an impacting portion of the debris swept forwardly by the sweeping means.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the drag shoe according to the present invention, for use in a street sweeping vehicle, as to the present invention's structure, organization, and use, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 1:
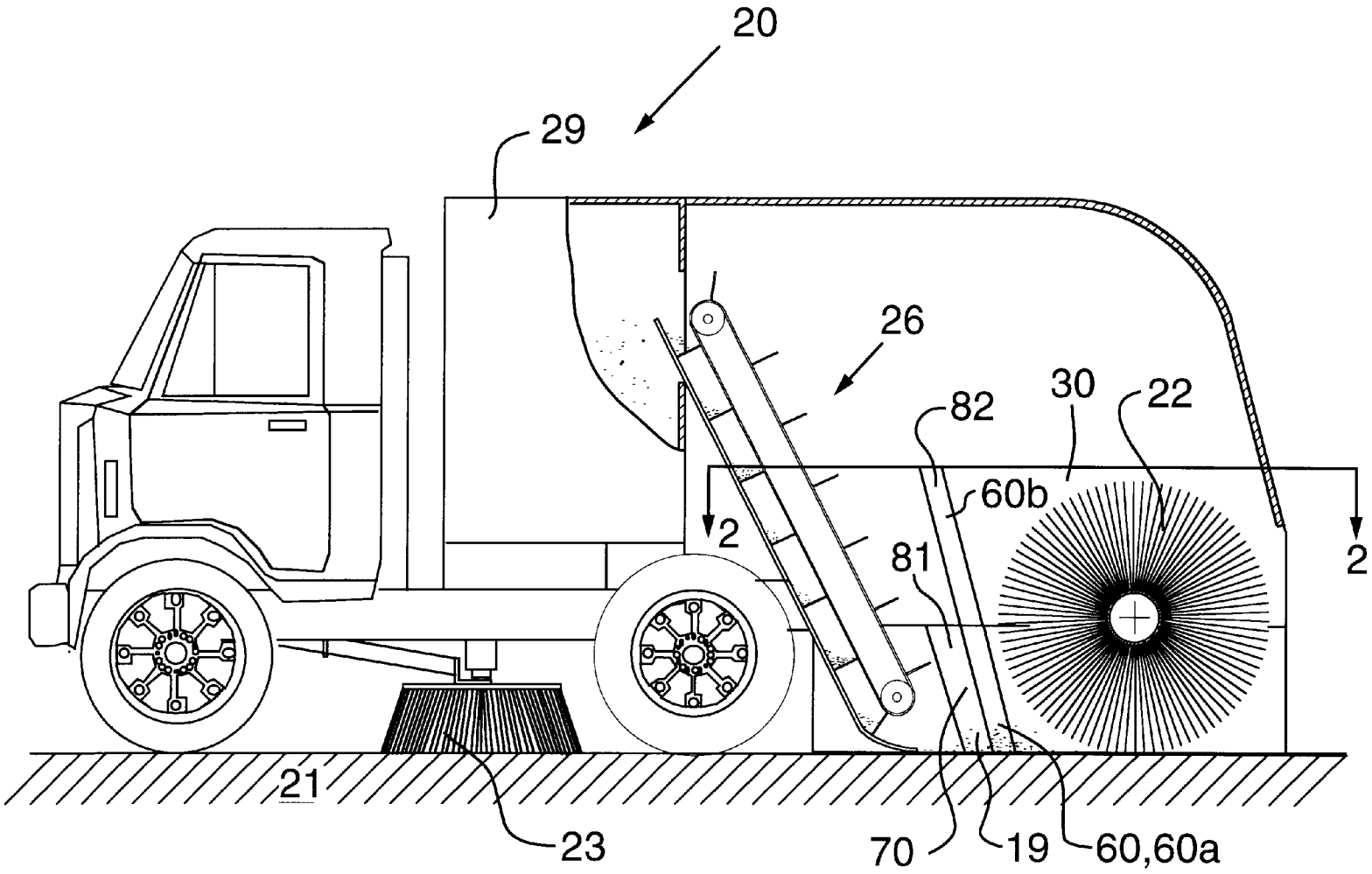
FIG. 1 is a side elevational view of a street sweeping vehicle having the preferred embodiment of the drag shoe according to the present invention installed thereon, with details omitted for the sake of clarity.

Reference will now be made to FIGS. 1 through 4 of the drawings in which a street sweeping vehicle 20 is shown. The street sweeping vehicle 20 has a generally centrally disposed longitudinal axis "L" and a sweeping means in the form of two counter-rotating brushes 23 (only one shown) and a sweeping brush 22. The sweeping brush 22 is operatively mounted on the frame 24 of the street sweeping vehicle 20 in road tracking relation by means of suitable mounting arms (not shown) so as to permit the street sweeping vehicle 20 to follow a road surface 21. Further, the sweeping brush 22 is mounted on the mounting arms (not shown) so as to be disposed laterally across the longitudinal axis "L", preferably across most of the width of the street sweeping vehicle 20, for selective rotation about a substantially horizontally disposed axis "A" by means of suitable bearings (not shown). The sweeping brush 22 is for sweeping debris forwardly into an elevator means in the form of an inclined elevator 26. The inclined elevator 26 is disposed forwardly of the sweeping brush 22 and is also disposed laterally across the longitudinal axis "L", preferably across most of the width of the street sweeping vehicle 20, in order to receive debris 19 swept forwardly by the sweeping brush 22, as indicated by arrow "F" in FIG. 3. Opposed left and right drag shoes 30*l* and 30*r* are disposed on opposite sides of the longitudinal axis "L" and laterally border the sweeping brush 22 at its lateral ends 22*l* and 22*r* and also laterally border elevator side plates 27*l* and 27*r* at the respective ends 26*l* and 26*r* of the elevator 26. Debris 19 that is swept forwardly by the sweeping brush 22 into the elevator 26 is lifted by elevator paddles 26*p* up an elevator ramp 28 into a hopper 29 for subsequent controlled dumping from the hopper 29. A drag flap 25 secured to a rearwardly disposed lip 25*l* of the elevator 26 precludes the debris 19 that is swept forwardly by the sweeping brush 22 from passing under the elevator 26.

The opposed left and right drag shoes 30*l* and 30*r* are almost identical one to the other except for being mirror images one of the other. Accordingly, for the sake of simplicity and ease of understanding, the left and right drag shoes 30*l* and 30*r* will typically be referred to in this specification singly and will be referenced by the single common reference numeral 30.

Each drag shoe 30 comprises a main body member 32 having a front end 34 and a back end 36. A replaceable polyethylene lower member 37 is mounted on the main body member 32 by means of threaded fasteners (not shown). Mounting means including axles 38, bushings 40, arm members 42, are provided for removably and replaceably mounting the drag shoe 30 on the street sweeping vehicle 20 in road tracking relation, so as to permit the drag shoe 30 to follow the road surface 21. A bottom surface 44 on the lower member 37 of the drag shoe 30 is shaped for substantially sealed contact with the road surface 21. In the present specification, the term road also refers to parking lots, airport runways, and the like.

The drag shoe 30 is mounted on the frame 24 of the street sweeping vehicle 20 such that a generally vertically disposed inwardly facing side surface 50 faces toward the generally centrally disposed longitudinal axis "L". The drag shoe 30 is mounted such that a contacting portion 51 of the generally vertically disposed inwardly facing side surface 50 is situated in intimately contacting relation against the respective adjacent of the ends 22*l* and 22*r* of the sweeping brush 22, so as to substantially preclude debris passing between the ends 22*l* and 22*r* of the sweeping brush 22 and the respective drag shoes 30*l* and 30*r*.

Operatively mounted on the street sweeping vehicle 20 is a substantially planar first angled deflector surface 60 having a front edge 61, a back edge 62, a top edge 63 and a bottom edge 64. The bottom edge 64 of the first angled deflector surface 60 is coincident with, and preferably substantially co-planar with, the bottom surface 44 on the lower member 37 of the drag shoe 30. In the preferred embodiment, as illustrated, the substantially planar first angled deflector surface 60 is of a quadrilateral shape, specifically a rectangle, but could also be essentially a triangular shape with the front and back edges extending upwardly to terminate in a top edge that is essentially a vertex.

In the preferred embodiment, the first angled deflector surface 60 is operatively mounted on the main body member 32 of the drag shoe 30, specifically on the generally vertically disposed inwardly facing side surface 50, so as to be proximate the side surface 50 such that the front edge 61 is disposed closer to the generally centrally disposed longitudinal axis "L" than is the back edge 62. In other words, the first angled deflector surface 60 is angled so as to face somewhat inwardly toward the generally centrally disposed longitudinal axis "L" and also to face somewhat rearwardly toward the sweeping brush 22. Preferably, the angle of orientation of the first angled deflector surface 60 is about 45° with respect to the side surface 50, but may be any suitable angle.

Figure 2:
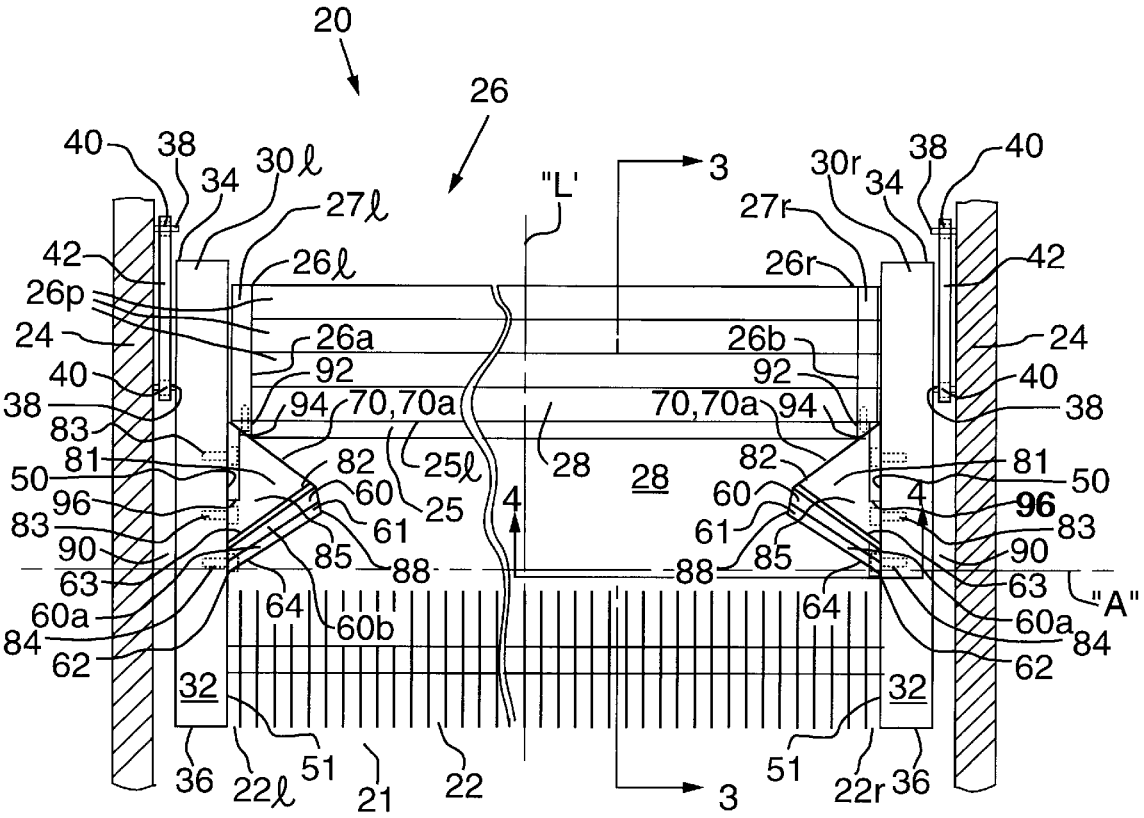
FIG. 2 is a sectional top plan view taken along section line 2—2 of FIG. 1, showing a portion of the street sweeping vehicle and the preferred embodiment of the drag shoe according to the present invention, installed in a street sweeping vehicle.
Figure 3:
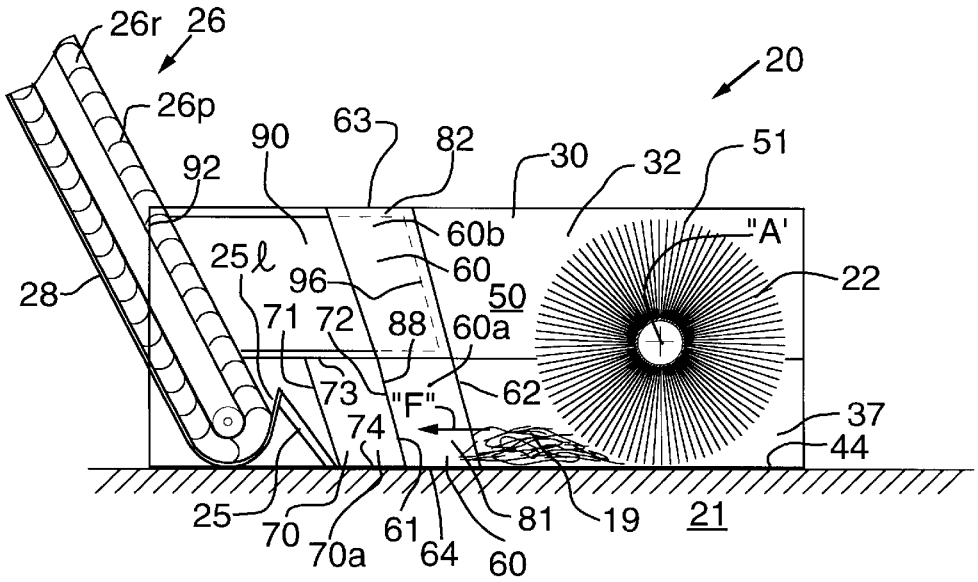
FIG. 3 is a side elevational view taken along section line 3—3 of FIG. 2, facing the side surface of the drag shoe and generally showing the interior compartment of the street sweeping vehicle.
Figure 4:
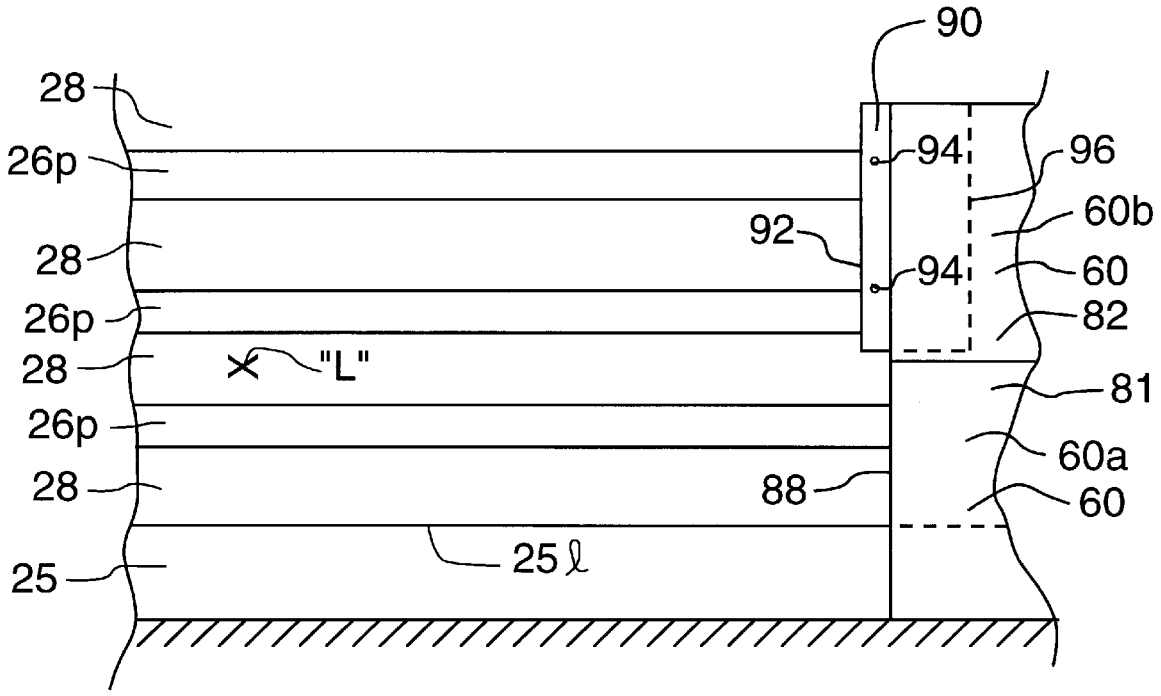
FIG. 4 is an end elevational view taken along section line 4—4 of FIG. 2, facing the elevator of the street sweeping vehicle and generally showing the interior compartment of the street sweeping vehicle.

It can be seen that the sweeping brush 22 sweeps the debris 19 forwardly, as indicated by arrow "F" in FIGS. 1, 2, and 3. A substantial portion of the debris 19, more specifically the debris swept forwardly by the central portion of the sweeping brush 22, is swept directly at the drag flap 25 and the inclined elevator 26. A smaller but significant portion of the debris 19 swept forwardly by the sweeping brush 22 is not swept directly at the drag flap 25 and the inclined elevator 26. Instead, adjacent each of the lateral ends 22*l* and 22*r* of the sweeping brush 22, a portion of the debris 19 swept forwardly by the sweeping brush 22, impacts against the first angled deflector surface 60 on the respective drag shoe 30, and deflects off the first angled deflector surface 60. Accordingly the first angled deflector surface 60 of each drag shoe substantially precludes direct forward passage, and also causes inwardly angled deflection toward the elevator 26, of an impacting portion of the debris 19 that is swept forwardly by the sweeping brush 22 toward the area of contact between the drag shoes 30 and the respective sides 26*a* and 26*b* of the elevator 26. In this manner, the debris 19 is precluded from reaching any possible gap between the drag shoes 30 and the respective sides 26*a* and 26*b* of the elevator 26, thus precluding the escape of the debris 19.

Also, in the preferred embodiment, the first angled deflector surface 60 is additionally angled upwardly from back to front, as can be seen best in FIG. 3, so as to further cause upwardly and inwardly angled deflection of debris swept forwardly by the sweeping brush 22.

At least a first portion 60*a* of the first angled deflector surface 60 is disposed on a deflector block 81 mounted in selectively removable and replaceable relation on the main body member 32 by means threaded fasteners 83. The deflector block 81 is preferably made from the same material as the lower member 37 of the drag shoe 30, typically polyethylene, so that both parts wear down at essentially the same rate.

A second portion 60*b* of the first angled deflector surface 60 is disposed on a deflector plate 82, which deflector plate 82 is also mounted on the main body member 32 of the drag shoe 30. The deflector plate 82 may be mounted by threaded fasteners 84 so as to be removable and replaceable, or may be welded in place. There should be no gap between the deflector block 81 and the deflector plate 82, as a gap would permit the passage of debris therethrough. The first and second portions 60*a*, 60*b* of the first angled deflector surface 60 may be substantially co-planar one with the other, as illustrated, but do not need to be.

Having the deflector block 81 mounted in removable and replaceable relation separately from the deflector plate 82 permits for selective minimization of the size of the part that must be replaced due to wear.

A flap member 90 is mounted at its proximal edge 92 on the elevator side plates 27*l* and 27*r* of the elevator 26 by means of threaded fasteners 94. The flap member 90 extends outwardly and rearwardly from the elevator 26 to terminate at its distal edge 96 disposed adjacent the side surface 50 of the drag shoe 30 forwardly of the deflector plate 82. The deflector plate 82 is shaped and oriented so as to provide a recess 85 between the deflector plate 82 and the side surface 50 of the drag shoe 30 forwardly of the deflector plate 82, which recess receives the distal edge 96 of the flap member 90. The distal edge 96 is not secured to the drag shoe 30 so as to permit relative vertical movement and horizontal movement of the flap member 90 with respect to the drag shoe 30, as the drag shoe 30 follows the road surface 21. The flap member 90 is preferably made from a flexible material so as to further accommodate horizontal movement of the flap member 90 with respect to the drag shoe 30 and preclude breakage of the flap member 90.

The flap member 90 also precludes direct forward passage and causing inwardly angled deflection of an impacting portion of the debris 19 swept forwardly by the sweeping brush 22. The deflector plate 82 also substantially precluding direct forward passage and causing inwardly angled deflection of an impacting portion of the debris 19 swept forwardly by the sweeping brush 22, which impacting portion of the debris 19 might otherwise pass between the distal edge 96 of the flap member 90 and the side surface 50. In this manner, the passage of debris between the deflector plate 82 and the elevator 26 is precluded.

Also operatively mounted on the street sweeping vehicle 20 is a substantially planar second angled deflector surface 70 having a front edge 71, a back edge 72, a top edge 73 and a bottom edge 74. The bottom edge 74 of the second angled deflector surface 70 is coincident with, and preferably substantially co-planar with, the bottom surface 44 on the lower member 37 of the drag shoe 30. In the preferred embodiment, as illustrated, the substantially planar second angled deflector surface 70 is of a quadrilateral shape, specifically a rectangle, but could also be essentially a triangular shape with the front and back edges extending upwardly to terminate in a top edge that is essentially a vertex.

In the preferred embodiment, the second angled deflector surface 70 is operatively mounted on the main body member 32 of the drag shoe 30, specifically on the generally vertically disposed inwardly facing side surface 50, so as to be proximate the side surface 50 and forwardly of said first angled deflector surface such that the back edge 72 is disposed closer to the generally centrally disposed longitudinal axis "L" than is the front edge 71. In other words, the second angled deflector surface 70 is angled so as to face somewhat inwardly toward the generally centrally disposed longitudinal axis "L" and also to face somewhat forwardly toward the elevator 26. Preferably, the angle of orientation of the second angled deflector surface 70 is about 45° with respect to the side surface 50, but may be any suitable angle.

Preferably, the second angled deflector surface 70 is also disposed on the deflector block 81 so as to be readily removable and replaceable.

It can be seen that the second angled deflector surface 70 substantially precludes direct rearward passage to the area of contact between the drag shoe 30 and the respective end of the sweeping brush 22 and also causes inwardly angled deflection of the portion of the debris 19 disposed on the road surface 21 in adjacent relation to the side surface 50 and proximate the front portion of the drag shoe 30.

The front edge 61 of the first angled deflector surface 60 and the back edge 72 of the second angled deflector surface 70 are substantially coincident one with the other at an vertex 88. In the preferred embodiment, the front edge 61 and the back edge 72, and therefore the vertex 88, is disposed at least about four centimeters from the side surface 50 such that the first angled deflector surface 60 provides ample blockage of the debris 19 swept forwardly by the sweeping brush 22 and directly propelled at the area of contact between the drag shoes 30 and the respective sides 26*a* and 26*b* of the elevator 26, and such that the second angled deflector surface 70 provides ample blockage of debris 19 on the road surface 21 adjacent the side surface 50 and proximate the front of the drag shoe 30.

Figure 5:
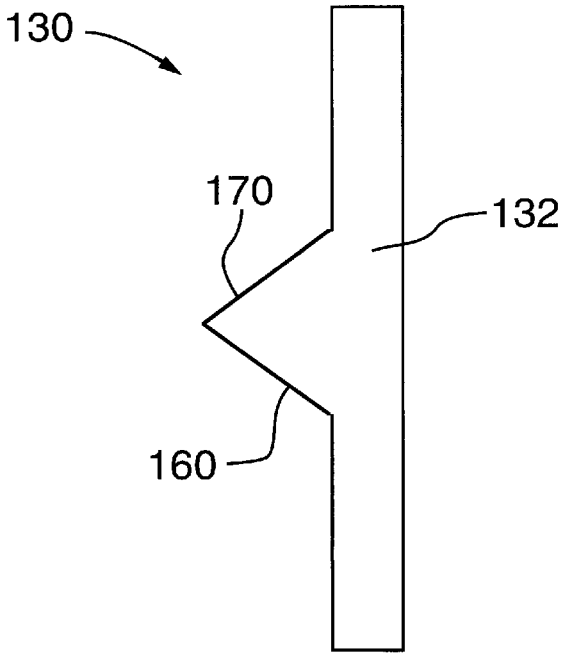
FIG. 5 is a top plan view of a first alternative embodiment of the drag shoe according to of the present invention, but not installed in a street sweeping vehicle.

In a first alternative embodiment, as shown in FIG. 5, the first and second angled deflector surfaces 160 and 170 are optionally formed as an integral part of the main body member 132 of the drag shoe 130.

Figure 6:
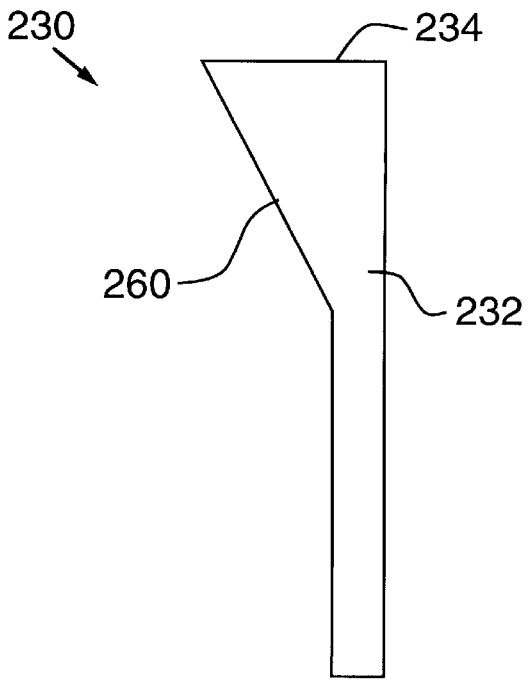
FIG. 6 is a top plan view of a second alternative embodiment of the drag shoe according to of the present invention, but not installed in a street sweeping vehicle.

In a second alternative embodiment, as shown in FIG. 6, there is no second angled deflector surface present. Instead, in order to preclude debris from becoming trapped and accumulating at the forwardly facing junction of a deflector bar type deflector, as in the prior art, thus lifting the drag shoe, the first angled deflector surface 260 terminates at the front end 234 of the main body member 232 of the drag shoe 230.

Figure 7:
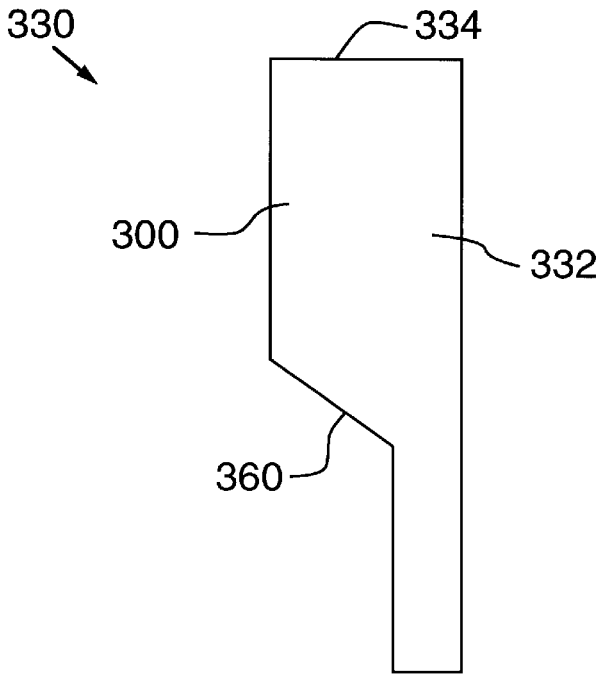
FIG. 7 is a top plan view of a third alternative embodiment of the drag shoe according to of the present invention, but not installed in a street sweeping vehicle.

In a third alternative embodiment, as shown in FIG. 7, again, there is no second angled deflector surface present. Instead, in order to preclude debris from becoming trapped and accumulating at the forwardly facing junction of a deflector bar type deflector, as in the prior art, thus lifting the drag shoe, a build-up precluding portion 300 is disposed between the first angled deflector surface 360 and the front end 334 of the main body member 332 of the drag shoe 330 so as to preclude build up of debris forwardly of the first angled deflector surface 360.

Other variations of the above principles will be apparent to those who are knowledgeable in the field of the invention, and such variations are considered to be within the scope of the present invention. Further, other modifications and alterations may be used in the design and manufacture of the drag shoe of the present invention without departing from the spirit and scope of the accompanying claims.

We claim:

1. In a street sweeping vehicle having a generally centrally disposed longitudinal axis, a sweeping means disposed laterally across said longitudinal axis for sweeping debris forwardly into an elevator means disposed forwardly of said sweeping means and laterally across said generally centrally disposed longitudinal axis, and opposed left and right drag shoes disposed on opposite sides of said longitudinal axis and laterally bordering said sweeping means and elevator means, wherein said elevator means lifts debris received from said sweeping means into a hopper for subsequent controlled dumping therefrom, each said drag shoe comprising:

a main body member having a front end and a back end;

mounting means for mounting said drag shoe on said street sweeping vehicle in road tracking relation;

a bottom surface shaped for substantially sealed contact with a road surface;

a generally vertically disposed inwardly facing side surface having a contacting portion situated in intimately contacting relation against said sweeping means so as to substantially preclude debris passing between said contacting portion and said sweeping means; and a first angled deflector surface having front, back, top and bottom edges and being operatively mounted on said street sweeping vehicle proximate said side surface such that said front edge is disposed closer to said longitudinal axis than is said back edge, said first angled deflector surface including means for substantially precluding direct forward passage of said debris over said top edge and causing inwardly angled deflection of an impacting portion of said debris swept forwardly by said sweeping means.

2. The drag shoe of claim 1, wherein said first angled deflector surface is operatively mounted on said main body member of said drag shoe.

3. The drag shoe of claim 2, wherein said first angled deflector surface is operatively mounted on said generally vertically disposed inwardly facing side surface of said drag shoe.

4. The drag shoe of claim 3, wherein said bottom edge of said first angled deflector surface is substantially co-planar with said bottom surface of said drag shoe.

5. The drag shoe of claim 4, further comprising a second angled deflector surface having front, back, top and bottom edges and being operatively mounted on said street sweeping vehicle proximate said side surface forwardly of said first angled deflector surface and such that said back edge is disposed closer to said longitudinal axis than is said front edge, said second angled deflector surface substantially precluding direct rearward passage and causing inwardly angled deflection of debris disposed on a road surface in adjacent relation to said side surface.

6. The drag shoe of claim 5, wherein said second angled deflector surface is operatively mounted on said main body member of said drag shoe.

7. The drag shoe of claim 6, wherein said second angled deflector surface is operatively mounted on said generally vertically disposed inwardly facing side surface of said drag shoe.

8. The drag shoe of claim 7, wherein said bottom edge of said second angled deflector surface is substantially co-planar with said bottom surface of said drag shoe.

9. The drag shoe of claim 8, wherein said first angled deflector surface is substantially planar.

10. The drag shoe of claim 9, wherein said second angled deflector surface is substantially planar.

11. The drag shoe of claim 10, wherein said front edge of said first angled deflector surface and said back edge of said second angled deflector surface are substantially coincident one with the other.

12. The drag shoe of claim 11, wherein said front edge of said first angled deflector surface is disposed at least about four centimeters from said generally vertically disposed inwardly facing side surface.

13. The drag shoe of claim 5, wherein at least a first portion of said first angled deflector surface and at least a first portion of said second angled deflector surface are disposed on a deflector block mounted in selectively removable and replaceable relation on said main body member of said drag shoe.

14. The drag shoe of claim 13, wherein said deflector block is made from polyethylene.

15. The drag shoe of claim 13, wherein a second portion of said first angled deflector surface is disposed on a deflector plate mounted on said main body member.

16. The drag shoe of claim 15, wherein said first and second portions of said first angled deflector surface are substantially co-planar one with the other.

17. The drag shoe of claim 15, further comprising a flap member mounted at its proximal edge on said elevator means and extending outwardly therefrom to terminate at its distal edge disposed adjacent said generally vertically disposed inwardly facing side surface forwardly of said deflector plate.

18. The drag shoe of claim 17, wherein said flap member is made from a flexible material.

19. The drag shoe of claim 18, wherein said deflector plate is shaped so as to provide a recess between said deflector plate and said generally vertically disposed inwardly facing side surface forwardly of said deflector plate, which recess receives said distal edge of said flap member.

20. The drag shoe of claim 1, wherein said first angled deflector surface is additionally angled forwardly and upwardly so as to cause upwardly and inwardly angled deflection of debris swept forwardly by said sweeping means.

21. The drag shoe of claim 5, wherein said first and second angled deflector surfaces are formed as an integral part of said main body member.

22. The drag shoe of claim 9, wherein the angle of orientation of said first angled deflector surface is about 30° with respect to said generally centrally disposed longitudinal axis.

23. The drag shoe of claim 10, wherein the angle of orientation of said second angled deflector surface is about 30° with respect to said generally centrally disposed longitudinal axis.

* * * * *